US011114109B2

(12) United States Patent
Bryan et al.

(10) Patent No.: US 11,114,109 B2
(45) Date of Patent: Sep. 7, 2021

(54) MITIGATING NOISE IN AUDIO SIGNALS

(71) Applicant: Apple Inc., Cupertino, CA (US)

(72) Inventors: Nicholas J. Bryan, Belmont, CA (US); Qing Yang, San Jose, CA (US); Vasu Iyengar, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/785,480

(22) Filed: Feb. 7, 2020

(65) Prior Publication Data

US 2021/0074310 A1 Mar. 11, 2021

Related U.S. Application Data

(60) Provisional application No. 62/897,925, filed on Sep. 9, 2019.

(51) Int. Cl.

| | |
|---|---|
| ***G10L 21/0216*** | (2013.01) |
| ***H04R 3/00*** | (2006.01) |
| ***G10L 21/0208*** | (2013.01) |

(52) U.S. Cl.

CPC ..... *G10L 21/0216* (2013.01); *H04R 3/005* (2013.01); *G10L 2021/02082* (2013.01); *G10L 2021/02165* (2013.01); *H04R 2410/05* (2013.01); *H04R 2410/07* (2013.01)

(58) Field of Classification Search

CPC ..... G10L 21/0216; G10L 2021/02165; G10L 2021/02082; G10L 2021/02166; G10L 21/0208; G10L 21/0232; G10L 25/84; G10L 15/20; G10L 15/22; G10L 19/012; G10L 2021/02161; H04R 3/005; H04R 2410/05; H04R 2410/07; H04R 1/406; H04R 3/02

See application file for complete search history.

(56) References Cited

U.S. PATENT DOCUMENTS

| | | | | |
|---|---|---|---|---|
| 2010/0280824 | A1* | 11/2010 | Petit | H04R 3/04 704/214 |
| 2012/0128175 | A1* | 5/2012 | Visser | H04R 3/005 381/92 |
| 2014/0126745 | A1* | 5/2014 | Dickins | H04R 3/02 381/94.3 |
| 2016/0360314 | A1* | 12/2016 | Iyengar | H04R 1/406 |
| 2019/0259381 | A1* | 8/2019 | Ebenezer | H04R 3/005 |

* cited by examiner

*Primary Examiner* — Yogeshkumar Patel

(74) *Attorney, Agent, or Firm* — Morgan, Lewis & Bockius LLP

(57) ABSTRACT

A device implementing a system for mitigating noise includes at least one processor configured to receive a first audio signal corresponding to a first microphone, and determine whether wind noise is present based at least in part on the first audio signal. The processor is configured to select, based on the determining, a second audio signal from between second and third microphones. The second microphone is disposed at a location that experiences less echo coupling when the device is in a particular orientation with respect to a user. The third microphone is disposed at another location that experiences less wind noise. The processor is configured to determine voice and noise reference values based on the first and the selected second audio signals, and perform noise suppression with respect to at least one of the first or the selected second audio signal, based on the voice or the noise reference value.

20 Claims, 7 Drawing Sheets

MITIGATING NOISE IN AUDIO SIGNALS

CROSS REFERENCE TO RELATED APPLICATIONS

This application claims the benefit of priority to U.S. Provisional Patent Application No. 62/897,925, entitled "Mitigating Noise in Audio Signals," and filed on Sep. 9, 2019, the disclosure of which is hereby incorporated herein in its entirety.

TECHNICAL FIELD

The present description relates generally to mitigating noise in audio signals, including mitigating noise in audio signals for detecting and/or enhancing user speech.

BACKGROUND

An electronic device may include multiple microphones. The multiple microphones may produce audio signals which include sound from a source, such as a user speaking to the device.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
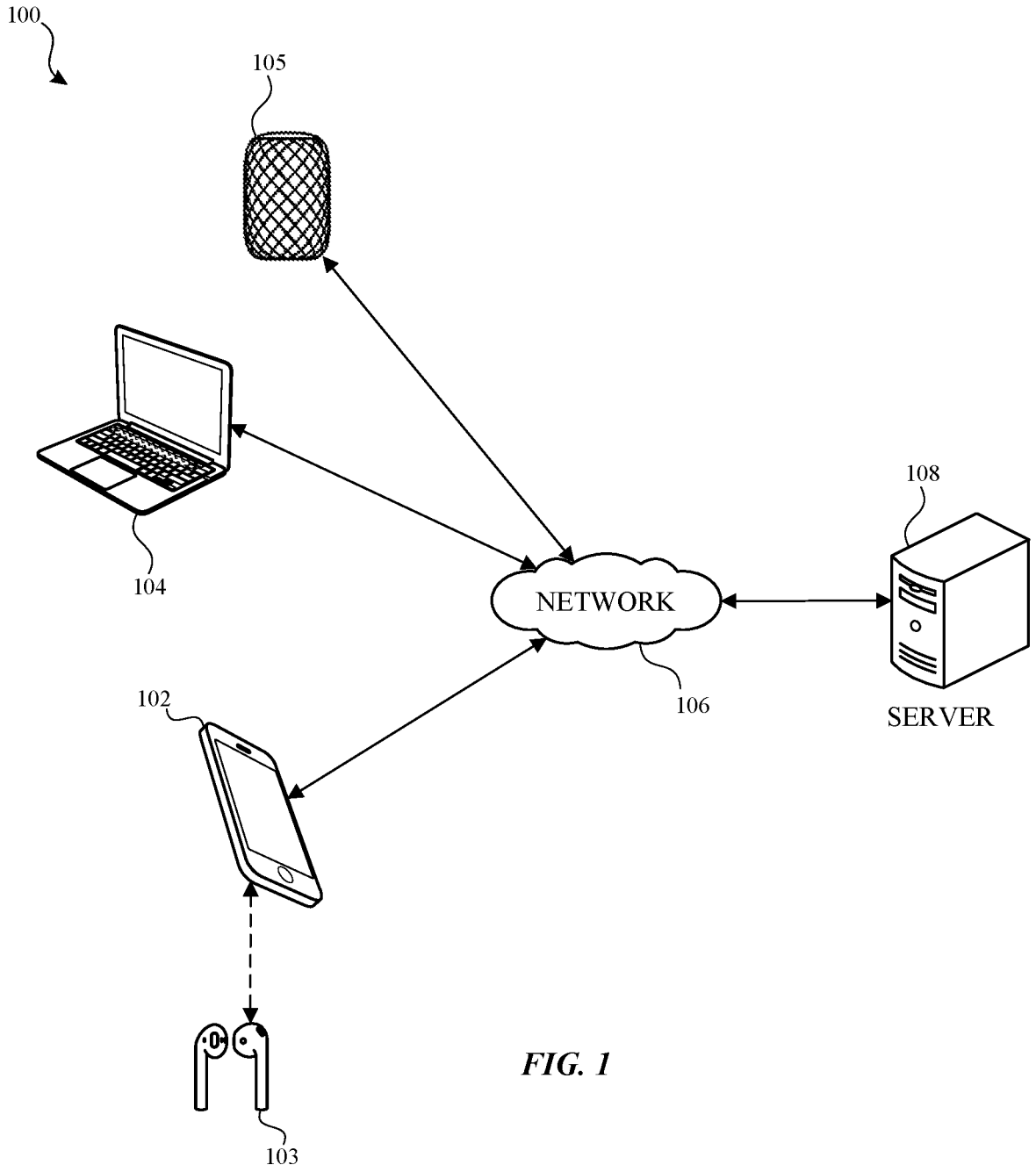
FIG. 1 illustrates an example network environment for mitigating noise in audio signals in accordance with one or more implementations.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other implementations. In one or more implementations, structures and components are shown in block diagram form in order to avoid obscuring the concepts of the subject technology.

An electronic device may include multiple microphones. The microphones may produce audio signals, which may contain desired and/or undesired audio from one or more sound sources. For example, the audio may include a speech signal corresponding to a user speaking to the device and/or environmental noise such as wind noise. The speech signal corresponding to the user speaking may be desired while the environmental noise, which may interfere with and/or otherwise distort the speech signal, may be undesired.

The subject system provides for mitigating the presence of undesired audio, such as wind noise, when capturing audio signals. An electronic device implementing the subject system may include three or more microphones, disposed at different locations on the device, where the microphones capture respective audio signals. When the electronic device is in a particular orientation (e.g., upright and facing the user), a first microphone may correspond to predominantly speech signal capture, while the second and third microphones may correspond to predominantly noise capture. For example, the second microphone may be disposed on a back surface of the device, and the third microphone may be disposed on a front surface (e.g., the same surface on which the first microphone is disposed). Due to the different positions of the microphones on the electronic device, when the electronic device is in the particular orientation, the second microphone may generally experience less echo coupling than the third microphone (e.g., since the second microphone is disposed on the back of the device facing away from the user), while the third microphone may generally experience less wind noise than the second microphone (e.g., since the third microphone is disposed on the front of the device facing towards the user).

In the subject system, the electronic device may use the audio signal produced by the first microphone (e.g., corresponding to predominantly the speech signal capture) to determine if wind noise is present (e.g., via a wind detector). Based on the presence of wind noise, the electronic device may select between using the audio signal from either the second microphone (e.g., less echo) or the third microphone (e.g., less wind noise) for performing blind source separation. For example, when wind noise is not present, the electronic device may select the audio signal from the second microphone that experiences less echo coupling. However, in the presence of wind noise, the electronic device may select the audio signal from the third microphone (that experiences less wind noise), and the electronic device may then process the selected audio signal to reduce the echo coupling experienced by the third microphone.

The electronic device may use the selected audio signal, together with the audio signal from the first microphone, to perform the blind source separation. The blind source separation may be used to determine voice and/or noise reference values from the received audio signals, and noise suppression may be performed based on the voice and/or noise reference values for enhanced speech signal output. Since the signals input to the blind source separation are adaptively selected based on the presence of wind noise, the subject system can reduce and/or minimize the amount of wind noise that is input to the blind source separation, thereby improving the quality of the voice and/or noise reference values output by the blind source separation and consequently improving the noise suppression performed using the voice and/or noise reference values.

FIG. 1 illustrates an example network environment for mitigating noise in audio signals in accordance with one or more implementations. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The network environment 100 includes electronic devices 102, 104 and 105, a wireless audio input/output device 103, a network 106, and a server 108. The network 106 may communicatively (directly or indirectly) couple, for example, one or more of the electronic devices 102, 104, 105 and/or the server 108. In FIG. 1, the wireless audio input/output device 103 is illustrated as not being directly coupled to the network 106; however, in one or more implementations, the wireless audio input/output device 103 may be directly coupled to the network 106.

The network 106 may be an interconnected network of devices that may include, or may be communicatively coupled to, the Internet. In one or more implementations, connections over the network 106 may be referred to as wide area network connections, while connections between the electronic device 102 and the wireless audio input/output device 103 may be referred to as peer-to-peer connections. For explanatory purposes, the network environment 100 is illustrated in FIG. 1 as including three electronic devices 102, 104 and 105, a single wireless audio input/output device 103, and a single server 108; however, the network environment 100 may include any number of electronic devices, wireless audio input/output devices and/or servers.

The server 108 may be, and/or may include all or part of the electronic system discussed below with respect to FIG. 7. The server 108 may include one or more servers, such as a cloud of servers. For explanatory purposes, a single server 108 is shown and discussed with respect to various operations. However, these and other operations discussed herein may be performed by one or more servers, and each different operation may be performed by the same or different servers.

Each of the electronic devices 102, 104, 105 may be, for example, a portable computing device such as a laptop computer, a smartphone, a peripheral device (e.g., a digital camera, headphones), a tablet device, a smart speaker, a set-top box, a content streaming device, a wearable device such as a watch, a band, and the like, or any other appropriate device that includes one or more wireless interfaces, such as one or more near-field communication (NFC) radios, WLAN radios, Bluetooth radios, Zigbee radios, cellular radios, and/or other wireless radios. In FIG. 1, by way of example, the electronic device 102 is depicted as a smartphone, the electronic device 104 is depicted as a laptop computer, and the electronic device 105 is depicted as a smart speaker. Each of the electronic devices 102, 104 and 105 may be, and/or may include all or part of, the electronic device discussed below with respect to FIG. 2, and/or the electronic system discussed below with respect to FIG. 7.

The wireless audio input/output device 103 may be, for example, a wireless headset device, wireless headphones, one or more wireless earbuds (or any in-ear, against the ear or over-the-ear device), a smart speaker, or generally any device that includes audio input circuitry (e.g., a microphone) and/or one or more wireless interfaces, such as near-field communication (NFC) radios, WLAN radios, Bluetooth radios, Zigbee radios, and/or other wireless radios. In FIG. 1, by way of example, the wireless audio input/output device 103 is depicted as a set of wireless earbuds.

As is discussed further below, one or more of the electronic devices 102, 104, 105 and/or the wireless audio input/output device 103 may include one or more microphones that may be used, in conjunction with the architectures/components described herein, for mitigating the presence of wind noise in the surrounding environment. One or more of the wireless audio input/output device 103 may be, and/or may include all or part of, the wireless audio input/output device discussed below with respect to FIG. 2, and/or the electronic system discussed below with respect to FIG. 7.

In one or more implementations, one or more of the wireless audio input/output device 103 may be paired, such as via Bluetooth, with the electronic device 102 (e.g., or with one of the electronic devices 104-105). After the two devices 102 and 103 are paired together, the devices 102 and 103 may automatically form a secure peer-to-peer connection when located proximate to one another, such as within Bluetooth communication range of one another. The electronic device 102 may stream audio, such as music, phone calls, and the like, to the wireless audio input/output device 103. For explanatory purposes, the subject technology is described herein with respect to a wireless connection between the electronic device 102 and the wireless audio input/output device 103. However, the subject technology can also be applied to a wired a connection between the electronic device 102 and input/output devices.

Figure 2:
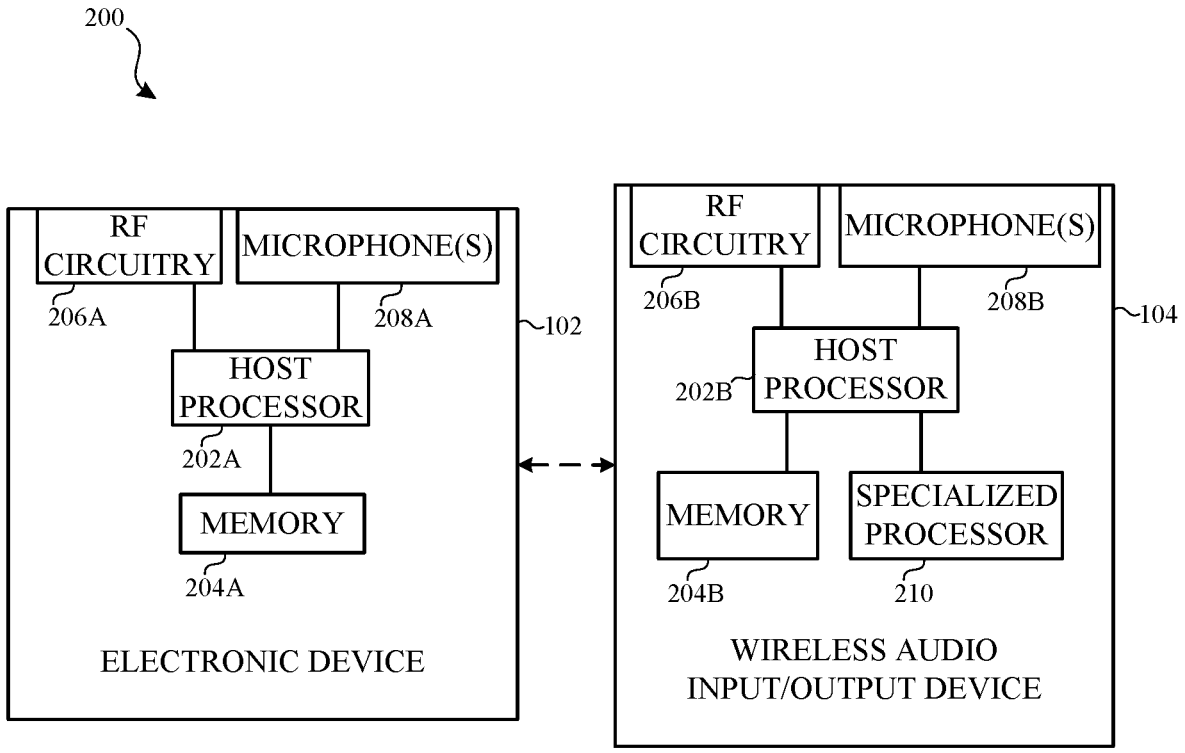
FIG. 2 illustrates an example network environment including an example electronic device and an example wireless audio input/output device in accordance with one or more implementations.

FIG. 2 illustrates an example network environment including an example electronic device and an example wireless audio input/output device in accordance with one or more implementations. The electronic device 102 is depicted in FIG. 2 for explanatory purposes; however, one or more of the components of the electronic device 102 may also be implemented by other electronic device(s) (e.g., one or more of the electronic devices 104-105). Similarly, the wireless audio input/output device 103 is depicted in FIG. 2 for explanatory purposes; however, one or more of the components of the wireless audio input/output device 103 may also be implemented by other device(s) (e.g., a headset and/or headphones). Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The electronic device 102 may include a host processor 202A, a memory 204A, radio frequency (RF) circuitry 206A and/or one or more microphone(s) 208A. The wireless audio input/output device 103 may include one or more processors, such as a host processor 202B and/or a specialized processor 210. The wireless audio input/output device 103 may further include a memory 204B, RF circuitry 206B and/or one or more microphone(s) 208B. While the network environment 200 illustrates microphone(s) 208A-B, it is possible for other types of sensor(s) to be used instead of, or addition to, microphone(s) (e.g., other types of sound sensor (s), an accelerometer, and the like).

The RF circuitries 206A-B may include one or more antennas and one or more transceivers for transmitting/receiving RF communications, such as WiFi, Bluetooth, cellular, and the like. In one or more implementations, the RF circuitry 206A of the electronic device 102 may include circuitry for forming wide area network connections and peer-to-peer connections, such as WiFi, Bluetooth, and/or cellular circuitry, while the RF circuitry 206B of the wireless audio input/output device 103 may include Bluetooth, WiFi, and/or other circuitry for forming peer-to-peer connections.

The host processors 202A-B may include suitable logic, circuitry, and/or code that enable processing data and/or controlling operations of the electronic device 102 and the wireless audio input/output device 103, respectively. In this regard, the host processors 202A-B may be enabled to provide control signals to various other components of the electronic device 102 and the wireless audio input/output device 103, respectively. Additionally, the host processors 202A-B may enable implementation of an operating system or may otherwise execute code to manage operations of the electronic device 102 and the wireless audio input/output device 103, respectively. The memories 204A-B may include suitable logic, circuitry, and/or code that enable storage of various types of information such as received data, generated data, code, and/or configuration information. The memories 204A-B may include, for example, random access memory (RAM), read-only memory (ROM), flash, and/or magnetic storage.

In one or more implementations, a given electronic device, such as the wireless audio input/output device 103, may include a specialized processor (e.g., the specialized processor 210) that may be always powered on and/or in an active mode, e.g., even when a host/application processor (e.g., the host processor 202B) of the device is in a low power mode or in an instance where such an electronic device does not include a host/application processor (e.g., a CPU and/or GPU). Such a specialized processor may be a low computing power processor that is engineered to utilize less energy than the CPU or GPU, and also is designed, in an example, to be running continuously on the electronic device in order to collect audio and/or sensor data. In an example, such a specialized processor can be an always on processor (AOP), which may be a small and/or low power auxiliary processor. In one or more implementations, the specialized processor 210 can be a digital signal processor (DSP).

The specialized processor 210 may be implemented as specialized, custom, and/or dedicated hardware, such as a low-power processor that may be always powered on (e.g., to collect and process audio signals provided by the microphone(s) 208B), and may continuously run on the wireless audio input/output device 103. The specialized processor 210 may be utilized to perform certain operations in a more computationally and/or power efficient manner. In an example, the specialized processor 210 may implement a system for mitigating noise, as described herein. In one or more implementations, the wireless audio input/output device 103 may only include the specialized processor 210 (e.g., exclusive of the host processor 202B).

One or more of the microphone(s) 208A-B may include one or more external microphones, one or more internal microphones, or a combination of external microphone(s) and/or internal microphone(s). As discussed further below with respect to FIGS. 3-5, one or more of the devices 102 and 103 may be configured to implement a system for mitigating noise, where the system processes audio signals provided by the respective one or more microphone(s) 208A or 208B. In one or more implementations, the system for enhanced speech detection and/or output may further be based on signals provided other sensor(s) (e.g., non-audio signals provided by an image sensor and/or a radar sensor).

In one or more implementations, one or more of the host processors 202A-B, the memories 204A-B, the RF circuitries 206A-B, the microphone(s) 208A-B and/or the specialized processor 210, and/or one or more portions thereof, may be implemented in software (e.g., subroutines and code), may be implemented in hardware (e.g., an Application Specific Integrated Circuit (ASIC), a Field Programmable Gate Array (FPGA), a Programmable Logic Device (PLD), a controller, a state machine, gated logic, discrete hardware components, or any other suitable devices) and/or a combination of both.

Figure 3:
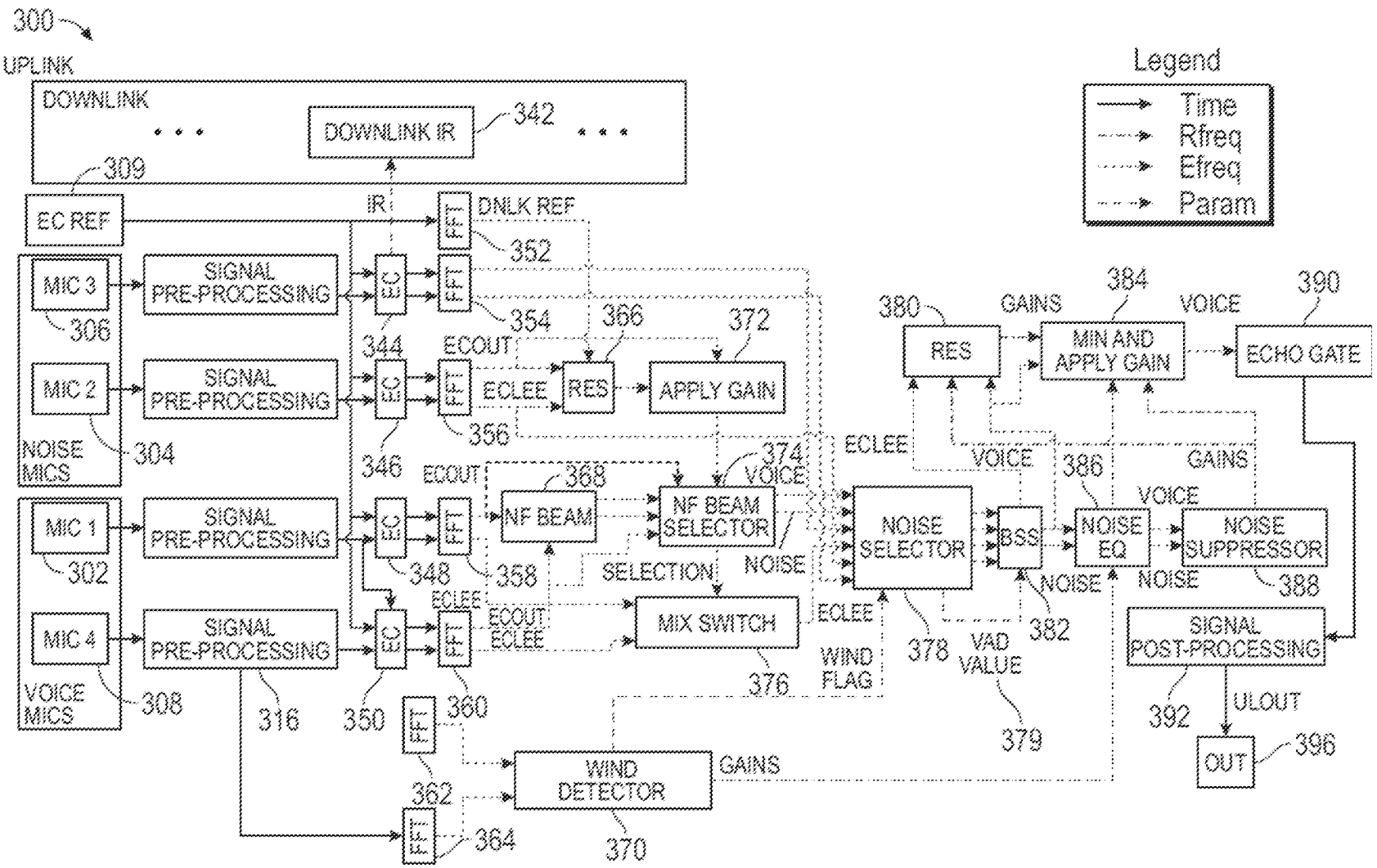
FIG. 3 illustrates a block diagram of an example architecture for mitigating noise in audio signals in accordance with one or more implementations.

FIG. 3 illustrates a block diagram of an example architecture for mitigating noise in audio signals in accordance with one or more implementations. For explanatory purposes, the architecture 300 is primarily described herein as being implemented by the electronic device 102 of FIG. 1. However, the architecture 300 is not limited to the electronic device 102 of FIG. 1, and may be implemented may be implemented by one or more other components and other suitable devices (e.g., the wireless audio input/output device 103). Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The architecture 300 may include microphones 302-308, an echo control (EC) reference module 309, signal preprocessing modules 310-316, downlink IR module 342, EC modules 344-350, fast Fourier transform (FFT) modules 352-364, a residual error suppressor (RES) 366, a near-field (NF) beamformer 368, a wind detector module 370, an apply gain module 372, an NF beam selector 374, a mix switch 376, a noise selector 378, an RES 380, a blind source separation (BSS) module 382, a minimum and apply gain module 384, a noise equalizer 386, a noise suppressor 388, an echo gate 390, a signal post-processing module 392 and/or output 396.

As described herein, the architecture 300 may provide for mitigating noise with respect to the audio signals provided by the microphones 302-308. The architecture 300 leverages the positions of the microphones 302-308, for example, based on the electronic device 102 being in an expected orientation (e.g., held upright with a front surface of the electronic device 102 facing the user) when the user speaks into the electronic device 102. Some microphone position(s) may experience less wind noise in the particular orientation, while other microphone position(s) may experience less echo coupling in the particular orientation. The architecture 300 dynamically selects audio signal(s) based on microphone position(s) and the presence/absence of wind noise, as inputs for blind source separation (e.g., via the BSS module 382). In one or more implementations, when wind noise is not present it may be more desirable to utilize an audio signal from a microphone that experiences less echo coupling for performing the blind source separation. The architecture 300 further employs noise suppression (e.g., two-channel noise suppression via the noise equalizer 386) to remove/reduce noise while maintaining a clean audio signal with respect to a target voice.

As noted, the electronic device 102 may be in a particular expected orientation when the user is speaking into the electronic device 102. For example, the expected orientation of the electronic device 102 may be upright, with the front surface facing towards the user's mouth, and the back surface facing away from the user's mouth. Based on the this orientation, one or more of the microphone(s) 302-308 may experience less wind noise relative to the remaining microphone(s) 302-308.

Figure 4:
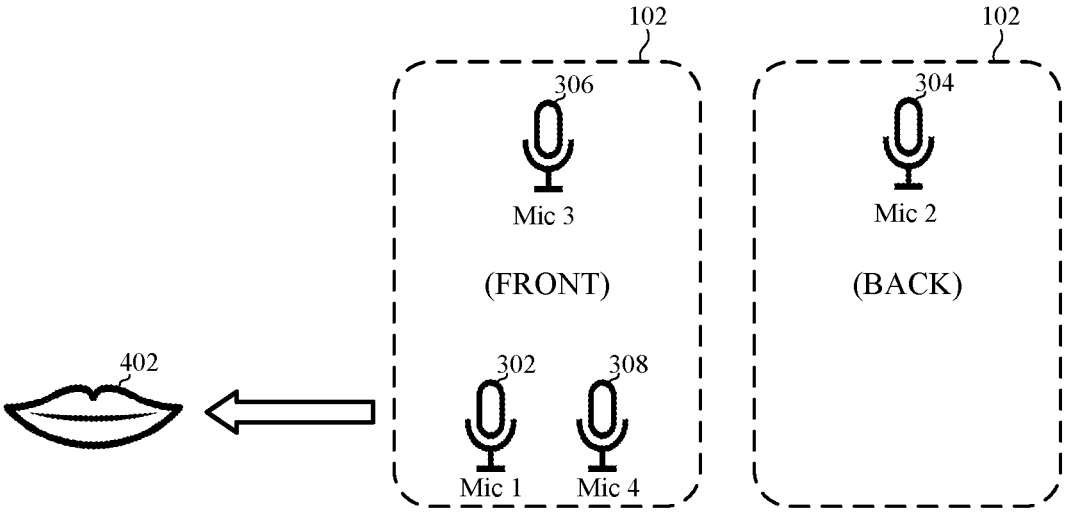
FIG. 4 illustrates an example arrangement of multiple microphones on an electronic device relative to a mouth of a user in accordance with one or more implementations.

An example arrangement for positioning the multiple microphones 302-308 relative to a mouth 402 of a user is illustrated FIG. 4. The microphones 302, 306 and 308 may be disposed toward a front surface of the electronic device 102, and the microphone 304 may be disposed toward a back surface of the electronic device 102. The microphones 302-308 may have different positions relative to the mouth 402 of the user (e.g., who may be holding the electronic device 102 in an upright position), such that respective audio signals from the microphones 302-308 have different (e.g., expected) magnitudes with respect to sound (e.g. acoustic waves) propagating from the mouth 402 and the respective audio signals may have different wind noise and/or echo coupling characteristics.

In one or more implementations, the microphones 302, 308 may predominantly correspond to speech signal capture (and may be referred to as voice microphones), since the microphones 302, 308 may be expected to have the higher magnitude with respect to the user's speech (e.g., when the electronic device 102 is in the expected orientation). On the other hand, the microphones 304, 306 may predominantly correspond to noise capture (and may be referred to as noise microphones), since the microphones 304, 306 may be expected to have a higher magnitude with respect to environmental noise (e.g., when the electronic device 102 is in the expected orientation).

Regarding environmental noise, based on microphone positioning when the electronic device 102 is in the expected orientation, the microphone 306 (e.g., positioned on the front of the electronic device 102) may experience less wind noise relative to the microphone 304 (e.g., positioned on the back of the electronic device 102). For example, the microphone 306 may be expected to be sheltered/shielded from wind when the electronic device 102 is held upright and/or pressed against the user's ear.

On the other hand, the microphone 304 may experience less echo coupling relative to the microphone 306 when the electronic device 102 is in the expected orientation. For example, the microphone 306 may be more prone to echo/feedback when downlink is active for the electronic device 102.

In the example of FIG. 4, the electronic device 102 corresponds to a smartphone and the expected device orientation during user speech is upright and pressed against the user's ear. Thus, microphones 304-306 may be more/less prone to wind noise and/or echo coupling relative to each other as discussed above. However, the tendency to experience more or less wind noise/echo coupling based on microphone position(s) may vary for other types of electronic device(s). For example, in a case of the wireless audio input/output device 103 (e.g., earbuds), a microphone disposed toward an inside of the earbud (when worn) may be less prone to wind noise relative to another microphone (disposed toward an outside of the earbud). In another example, in a case of a headphone/headset, a microphone disposed toward an inside of the ear cup (the portion of the ear cup facing/touching the user's ear when worn) may be less prone to wind noise relative to another microphone (e.g., disposed toward an outside of the ear cup). Thus, selection of the audio signal(s) corresponding to device microphone(s) that experience more or less wind noise and/or echo coupling as described herein may be based on the type of electronic device (e.g., smartphone, earbuds, headphones, and the like).

Referring back to FIG. 3, each of the audio signals provided by the microphones 302-308 may be processed and/or filtered by the signal pre-processing modules 310-316 (e.g., which may include processing such as trim, gain, finite impulse response (FIR) and/or band equalization), the EC modules 344-350 and/or the FFT modules 354-364.

With respect to downlink, the downlink IR module 342 may receive output from the EC module 344 (e.g., corresponding to the audio signal provided by the microphone 306). Moreover, the EC reference module 309 may provide a signal to the EC modules 344-350 and to the FFT module 352, which in turn may output a downlink reference value. The downlink reference value and the output from the FFT module 352 (e.g., corresponding to the audio signal provided by the microphone 304) may be provided as input to the RES 366, the output of which may be provided to the apply gain module 372. The output of the apply gain module 372 may be provided as input to the NF beam selector 374.

With respect to beamforming, the NF beamformer 368 may form a beam based on the respective audio signals corresponding to the microphone 302 and the microphone 308 (e.g., the bottom microphones of the electronic device 102 as shown in FIG. 4). In one or more implementations, the NF beam selector 374 may select the beam (e.g., select between microphone 302 or 308) that has a better signal-to-noise ratio with respect to user speech in the respective audio signal(s). The selected beam (e.g., microphone 302 or 308) may be used as voice input for the BSS module 382.

In addition to receiving a voice input component, the BSS module 382 may be configured to receive a noise input component. For example, a respective audio signal from either the microphone 304 or the microphone 306 may be provided as a noise input component to the BSS module 382. The selection may be based on the presence of wind noise with respect to the audio signal(s).

As shown in FIG. 3, the audio signals corresponding to the microphones 302 and 308 may be provided as input to respective FFT modules 362-364, the output of which is provided to the wind detector module 370. The wind detector module 370 may be configured to determine a wind probability indicating a likelihood of the presence of wind, for example, based on coherence between the audio signals from the microphones 302 and 308. This wind probability output by the wind detector module 370 may be used by the noise selector 378, to select an audio signal for providing to the BSS module 382.

Thus, the noise selector 378 is configured to select one of the respective audio signals from the microphones 304-306 based on the wind probability. In one or more implementations, in a case of normal environmental conditions (e.g., of no/minimal wind, where an amount of wind noise is below a predefined threshold), the microphone 304 may be selected by the noise selector 378. As noted above, the microphone 304 may experience less echo coupling relative to the microphone 306. On the other hand, in a case where wind is present (e.g., as indicated by the wind probability), the microphone 306 may be selected by the noise selector 378 in order to mitigate the presence of wind. As noted above, the microphone 306 may experience less wind noise (e.g., as being sheltered from wind when the electronic device 102 is pressed is against the user's ear) relative to the microphone 304.

Thus, the noise selector 378 is configured to provide an audio signal corresponding to one of the microphones 302 and 308 (e.g., a voice component) and an audio signal corresponding to one of the microphones 304 and 306 (e.g., a noise component) to the BSS module 382. As shown in the example of FIG. 3, the BSS module 382 may further receive a voice activity detector (VAD) value 379 as input from the noise selector 378.

In one or more implementations, the noise selector 378 may implement one or more voice activity detectors (VADs, not shown). Each VAD may be configured to detect the presence or absence of human speech with respect to a respective audio signal (e.g., corresponding to the microphone 304 or 306). In a case of normal environmental conditions where wind is not present (e.g., and the audio signal from microphone 304 is selected), a first VAD implemented by the noise selector 378 may calculate the VAD value 379 based on magnitude differences. For example, the first VAD may calculate the VAD value 379 as a ratio of a voice reference (e.g., from the NF beam selector 374, corresponding to the selected audio signal from microphone 302 or 308) and a noise reference (e.g., corresponding to the audio signal from the microphone 304). The VAD value may be used to guide the blind source separation performed by the BSS module 382, e.g. by providing an indication of when the speech is likely present.

On the other hand, in a case where wind is present (e.g., and the audio signal from microphone from microphone 306 is used as input), a second VAD implemented by the noise selector 378 may calculate the VAD value 379. The second VAD may calculate the VAD value 379 as a minimum statistics value (e.g., based on orthogonal channel noise simulation) derived at least in part on the audio signal from the microphone 306.

In one or more implementations, in a case where wind is present (e.g., and the audio signal from microphone from microphone 306 is used as input), a noise reference may be calculated based on the following Equation (1):

$$\text{noise reference}=\min(|\text{ecout}|,|\text{ec3ot}|)*\exp(j*\text{angle}(\text{ec3ot})) \quad \text{Equation (1)}$$

With respect to Equation (1), the noise reference may be used to mitigate loud echo associated with the microphone 306. Moreover, ecout and ec3ot may correspond to echo cancelled output from respective echo controls as shown in FIG. 3.

The BSS module 382 is configured to separate source signals (e.g., for voice and noise) from the selected audio signals and/or the VAD value 379 that the BSS module 382 receives as input. In addition, the BSS module 382 is configured to separate voice and noise components from the selected microphones 302-308 into voice and/or noise reference values for output.

In one or more implementations, the audio signal corresponding to the microphone 302 (e.g., when wind noise is present) may be used to assist in guiding the BSS module 382 with respect to a permutation problem typically associated with blind source separation. In addition, audio signal corresponding to the microphone 302 may be used as one of the inputs to improve the voice output from the BSS module 382. For example, less wind noise provided as input to the BSS module 382 may lead to less wind noise as output for the BSS module 382.

In one or more implementations, the BSS module 382 may be based on online auxiliary function-independence vector analysis (Aux-IVA), in which input sources are separated to maximize the source independence. In some cases, Aux-IVA may not recover the scaling and the ordering of the output. Thus, the architecture 300 may provide for using a minimum distortion principle (MDP) with respect to the BSS module 382.

The output from the BSS module 382 (e.g., noise reference value and/or voice reference value) may be provided as input to the noise equalizer 386. In one or more implementations, the noise equalizer 386 is configured to scale the noise reference value to match the noise level in the voice reference. In one or more implementations, the above-discussed VAD value 379 may be used to guide the noise equalizer 386. As noted above, the VAD value 379 may correspond to the ratio of the voice reference and the noise reference (e.g., corresponding to the microphone 304, on a bin-wise frame basis), or may instead correspond to minimum statistics value (e.g., corresponding to the microphone 306).

These VAD value(s) 379 may be used to (jointly) guide the noise equalizer 386. For example, in a noise-only frame, the bin-wise noise scaling may be updated. In a voice frame, the noise-scaling update may be frozen (e.g., for a speakerphone device) or may be slowly decreased to a scaling factor of 1.

With respect to the minimum and apply gain module 384, the architecture 300 may further provide for reducing the effects associated with hard switching and/or echo mitigation. In general, microphone switching may result in audio glitches. In some cases, the microphone 306 (e.g., which is sheltered from the wind) happens to be close to a device speaker, and therefore may have strong echo coupling. As a result, when far-end is active (e.g., when the downlink is active), the electronic device 102 may switch to other microphones with less echo coupling. Such hard switching may cause audible glitches.

The above-described blind source separation (e.g., via the BSS module 382) in conjunction with the VAD value 379 may separate out the voice signal as an independent source. Moreover, the echo source in the BSS input may be reduced by taking the minimal magnitude of the microphone 306 (e.g., which is sheltered from wind) and another microphone with less echo (e.g., the microphone 304), using the signal phase of the microphone 306, and re-synthesizing the BSS input. After BSS processing, the residual echo may be further attenuated with respect to the RES 380.

For example, the RES 380 may be used for post filtering following blind source separation. To drive the RES 380 (e.g., in a more aggressive manner), the echo canceller output of the microphone 306, instead of the BSS output, may be used to calculate over-suppression RES gains. Together with a dynamically calculated gain floor, it is possible to achieve a balance of echo reduction and voice quality.

As shown in the example of FIG. 3, the refined voice reference from the BSS module 382 and the scaled noise reference from noise equalizer 386 may be provided as input to the noise suppressor 388. In one or more implementations, the noise suppressor 388 may be configured to further remove the noise from the voice reference. Moreover, further signal processing may be performed by one or more of the echo gate 390, the signal post-processing module 392 (e.g., which may include processing such band equalization, compression, automatic gain control (AGC) and/or the soft clipping), in order to produce the output 396 (e.g., with mitigated wind noise).

In one or more implementations, one or more of the microphones 302-308, the EC reference module 309, the signal pre-processing modules 310-316, the downlink IR module 342, the EC modules 344-350, the FFT modules 352-364, the RES 366, the NF beamformer 368, the wind detector module 370, the apply gain module 372, the NF beam selector 374, the mix switch 376, the noise selector 378, the RES 380, the BSS module 382, the minimum and apply gain module 384, the noise equalizer 386, the noise suppressor 388, the echo gate 390, and/or the post-processing modules 392 may be implemented in software (e.g., subroutines and code stored in the memory 204B), hardware (e.g., an Application Specific Integrated Circuit (ASIC), the specialized processor 212, a Field Programmable Gate Array (FPGA), a Programmable Logic Device (PLD), a controller, a state machine, gated logic, discrete hardware components, or any other suitable devices), and/or a combination of both.

Figure 5:
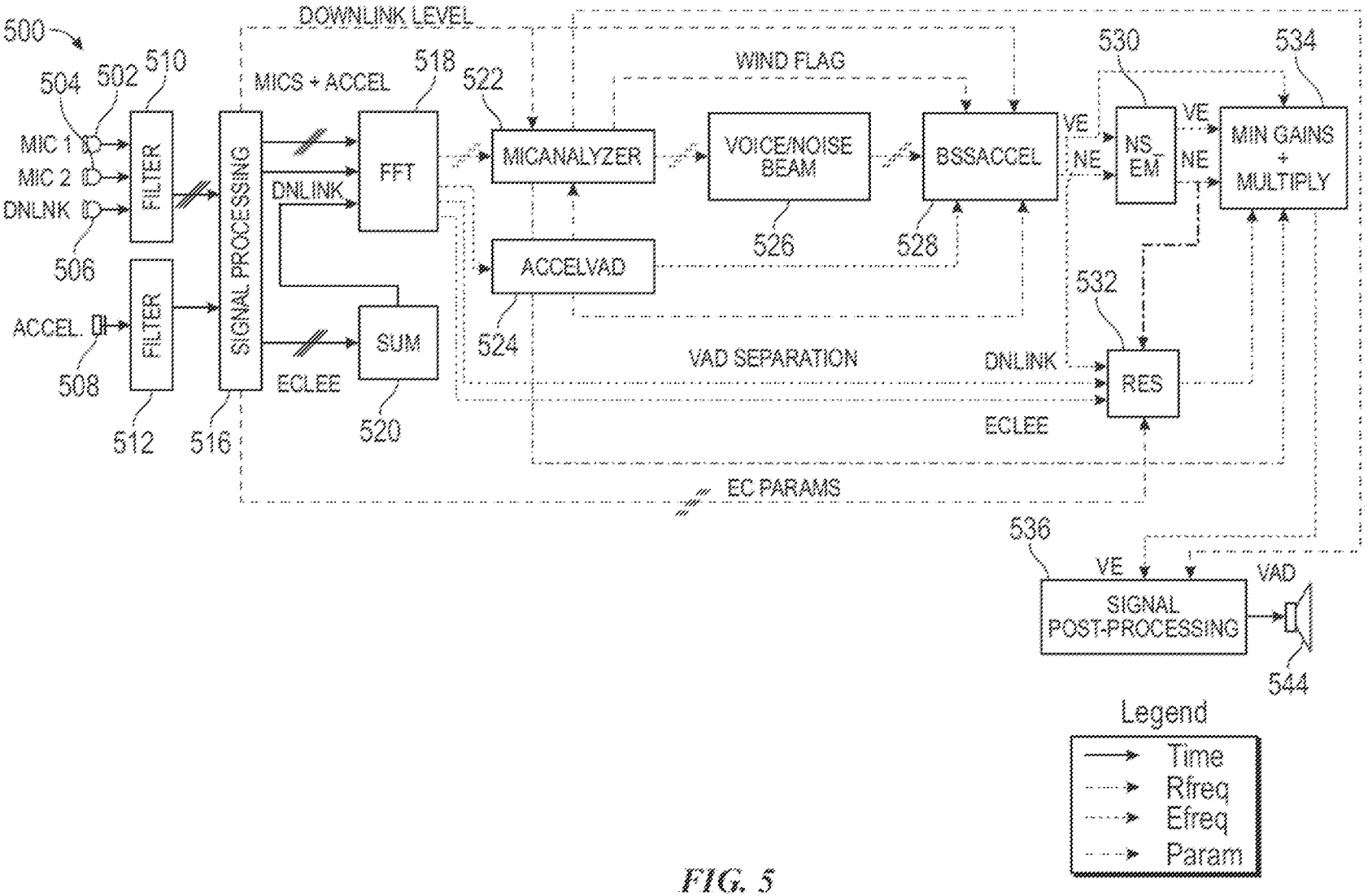
FIG. 5 illustrates a block diagram of another example architecture for mitigating noise in audio signals in accordance with one or more implementations.

FIG. 5 illustrates a block diagram of another example architecture for mitigating noise in audio signals in accordance with one or more implementations. For explanatory purposes, the architecture 500 is primarily described herein as being implemented by the wireless audio input/output device 103 of FIG. 1. However, the architecture 500 is not limited to the wireless audio input/output device 103 of FIG. 1, and may be implemented may be implemented by one or more other components and other suitable devices. Not all of the depicted components may be used in all implementations, however, and one or more implementations may include additional or different components than those shown in the figure. Variations in the arrangement and type of the components may be made without departing from the spirit or scope of the claims as set forth herein. Additional components, different components, or fewer components may be provided.

The architecture 500 may include microphones 502-504, a downlink module 506, an accelerometer 508, filters 510-512, a signal processing module 516, a fast Fourier transform (FFT) 518, a summation module 520, a microphone analyzer 522, an accelerometer-based VAD 524, a voice/noise beam module 526, an accelerometer-based BSS 528, a noise estimator 530, an RES 532, a minimum gains and multiply module 534, a signal post-processing module 536 and/or a speaker 544.

As shown in the example of FIG. 5, each of the audio signals provided by the microphones 502-504 and the downlink module 506 may be processed and/or filtered by the filter 510 (e.g., which may correspond with a digital filter configured to remove a DC component in the received microphone and a reference signal). In one or more implementations, the accelerometer 508 may be configured to detect vibration from user speech (e.g., and typically experiences minimal wind noise). The signal provided by the accelerometer 508 may be processed and/or filtered by the filter 512 (e.g., which may include high-pass and/or low-pass filtering). The filtered signals corresponding to the microphones 502-504, the downlink module 506 and the accelerometer 508 may then be further processed by the signal processing module 516 (e.g., which may include processing such as multi-delay block frequency domain adaptive filtering and/or acoustic echo cancellation), and subsequent signal(s) may be provided to one or more of the FFT 518, the summation module and the microphone analyzer 522.

In one or more implementations, the accelerometer-based VAD 524, the voice/noise beam module 526, and the accelerometer-based BSS 528 may correspond to three modules/components that are interdependent and provide for improved mitigation of wind noise (e.g., in conjunction with each another). The architecture 500 may be used to estimate the signal to noise ratio on the accelerometer 508 using a minimum statistics based noise estimator, and to derive a VAD from the estimated SNR on the accelerometer (e.g., the accelerometer-based VAD 524).

The accelerometer-based VAD 524 may be used to guide the accelerometer-based BSS 528. In one or more implementations, the signal from the accelerometer 508 (as processed) may be used an input for the accelerometer-based BSS 528. The accelerometer-based BSS 528 may be configured as a three-channel BSS in low frequencies and two-channel BSS in high frequencies. Alternatively or in addition (e.g., in a case where the accelerometer 508 is not available), the architecture 500 may instead use an inner microphone (e.g., disposed toward an inside of the ear) instead of the accelerometer 508.

In one or more implementations, the accelerometer-based VAD 524 may be configured to use the noise estimator (e.g., from a noise selector) to estimate a noise floor. The accelerometer-based VAD 524 may detect speech if the corresponding power spectrum is above the noise floor (e.g., a threshold value). Moreover, the accelerometer-based VAD 524 may be configured to determine averages across a frequency range (e.g., 0-700 Hz, corresponding to accelerometer bandwidth). The accelerometer-based VAD 524 may output a (e.g., a VAD signal of 0 or 1), and the output may indicate separation of a power spectrum vs. a noise floor.

The voice/noise beam module 526 may correspond to a filter-and-sum beamformer (e.g., with two omnidirectional microphone inputs, and two beam outputs). The voice/noise beam module 526 may be used to condition signals prior to adaptive beamforming (e.g., associated with the accelerometer-based BSS 528). In addition, the voice/noise beam module 526 may be used to generate a second VAD via a magnitude difference between beams. The second VAD may be combined with the accelerometer-based VAD 523, where the combined VAD may be used to generate an adaptive speech prior signal for the accelerometer-based BSS 528.

In addition, the accelerometer-based BSS 528 may be configured to perform adaptive beamforming and/or noise estimation. The accelerometer-based BSS 528 may employ Aux-IVA. For example, the Aux-IVA may correspond with a source separation/adaptive beamforming method based on a subband frequency-domain algorithm. The Aux-IVA may correspond with separating N sources from N microphone via statistical independence. For example, the Aux-IVA may typically perform well for directional noise sources (e.g. speech, music), and may have the physical limitations similar to an adaptive beamforming method.

In one or more implementations, the accelerometer-based BSS 528 may be configured to provide for one or more extensions such as: multimodal IVA, adaptive speech prior (AP), bandwidth constraints (BC) and/or adaptive noise EQ (NEQ), as discussed below.

For example, the multimodal IVA extension may correspond with leveraging the accelerometer 508 and the microphones 502-504. In one or more implementations, the multimodal IVA extension may be configured to use the noise robustness of the accelerometer 508 and the generally high fidelity of the microphones 502-504, to blend the microphones 502-504 and the accelerometer 508 as a byproduct of a separation algorithm.

The adaptive speech prior (AP) extension may be configured to assist with respect to the external permutation problem typically associated with blind source separation (e.g., to determine which output corresponds to voice). The AP extension may use an adaptive speech prior value to predetermine a voice source to be a first output. Moreover, while standard IVA may use fixed prior probability estimates of sources, the architecture 500 may provide for using the accelerometer 508 and the magnitude difference VAD to control speech prior probability, as discussed.

With respect to the above-mentioned bandwidth constraints (BC) extension, the accelerometer bandwidth may be limited (e.g., 0-700 Hz). As such, the IVA may be constrained as a cost function in order to address the bandwidth mismatch. While it may be possible to add linear optimization constraints, in one or more implementations, the architecture 500 may provide for performing three-channel BSS between 0-700 Hz, and two-channel above this range. This may also reduce computational cost and memory usage.

Regarding the adaptive noise EQ (NEQ) extension, after separation, noise may be overestimated, particularly for small devices. In one or more implementations, the architecture 500 may provide for scaling down the noise reference to match noise signal found in the voice reference. For example, the energy ratio between voice and noise may be used. If the energy ratio is low, the noise reference can be adapted to match the voice reference. If the energy ratio is high, the noise reference and voice reference values may be frozen.

In one or more implementations, a one-channel noise estimate may be blended when appropriate. In addition, leak gain calculation to a minimum statistics (e.g., an orthogonal channel noise simulation estimate) estimate may be performed during long periods of voice activity. Alternatively or in addition, when wind noise is present, the orthogonal channel noise simulation estimate may be used.

As shown in the example of FIG. 5, further signal processing may be performed by one or more of the noise estimator 530, the RES 532, the minimum gains and multiply module 534, the signal post-processing module 536 (e.g., which may include processing such as inverse FFT, equalization, automatic gain control and/or soft clipping) and/or the speaker 544, to produce audio output with mitigated wind noise.

In one or more implementations, one or more of the microphones 502-504, the downlink module 506, the accelerometer 508, the filters 510-512, the signal processing module 516, the FFT 518, the summation module 520, the microphone analyzer 522, the accelerometer-based VAD 524, the voice/noise beam module 526, the accelerometer-based BSS 528, the noise estimator 530, the RES 532, the minimum gains and multiply module 534, the signal post-processing module 536, and/or the speaker 544 may be implemented in software (e.g., subroutines and code stored in the memory 204B), hardware (e.g., an Application Specific Integrated Circuit (ASIC), the specialized processor 212, a Field Programmable Gate Array (FPGA), a Programmable Logic Device (PLD), a controller, a state machine, gated logic, discrete hardware components, or any other suitable devices), and/or a combination of both.

Figure 6:
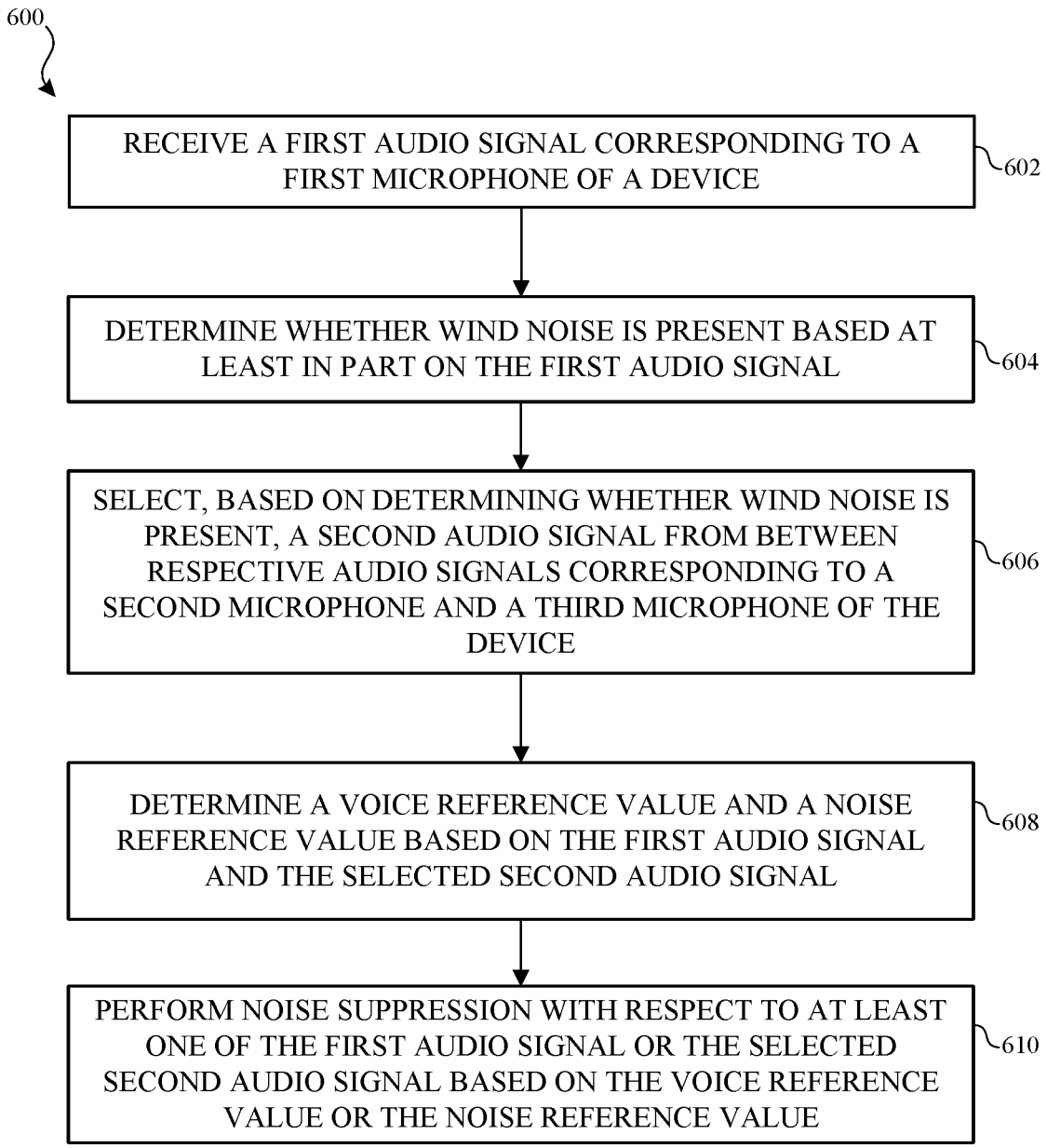
FIG. 6 illustrates a flow diagram of example process for mitigating noise in audio signals in accordance with one or more implementations.

FIG. 6 illustrates a flow diagram of example process for mitigating noise in audio signals in accordance with one or more implementations. For explanatory purposes, the process 600 is primarily described herein with reference to the electronic device 102 of FIG. 1. However, the process 600 is not limited to the electronic device 102 of FIG. 1, and one or more blocks (or operations) of the process 600 may be performed by one or more other components and other suitable devices (e.g., the wireless audio input/output device 103). Further for explanatory purposes, the blocks of the process 600 are described herein as occurring in serial, or linearly. However, multiple blocks of the process 600 may occur in parallel. In addition, the blocks of the process 600 need not be performed in the order shown and/or one or more blocks of the process 600 need not be performed and/or can be replaced by other operations.

The electronic device 102 receives a first audio signal corresponding to a first microphone of a device (602). The electronic device 102 determines whether wind noise is present in the surrounding environment based at least in part on the first audio signal (604).

The electronic device 102 selects, based on determining whether wind noise is present, a second audio signal from between respective audio signals corresponding to a second microphone and a third microphone of the electronic device 102 (606). The second microphone is disposed on the electronic device 102 at a location that experiences less echo coupling relative to the third microphone when the electronic device 102 is in a particular orientation with respect to a user of the electronic device 102 (e.g., the second microphone is disposed towards an outer surface relative to the user). The third microphone is disposed on the electronic device 102 at another location that experiences less wind noise relative to the second microphone when the electronic device 102 is in the particular orientation (e.g., the third microphone is disposed towards an inside surface relative to the user). The selected second audio signal may correspond to the second microphone when the wind noise is not present, and the selected second audio signal may correspond to the third microphone when the wind noise is present.

The electronic device 102 determines a voice reference value and a noise reference value based on the first audio signal and the selected second audio signal (608). For example, the electronic device 102 may perform blind source separation based on the first audio signal and the selected second audio signal to determine a voice reference value and/or a noise reference value. Performing the blind source separation may include separating a voice component and a noise component from the first audio signal and the selected second audio signal, to determine the voice reference value and the noise reference value.

In a case where the wind noise is not present (e.g., and the selected second audio signal corresponds to the second microphone), the electronic device 102 may perform voice activity detection based on a magnitude difference between the selected second audio signal and the first audio signal. The voice activity detection may be used to guide the blind source separation.

In a case where the wind noise is present (e.g., and the selected second audio signal corresponds to the third microphone), the electronic device 102 may perform the blind source separation based on a minimal magnitude of the selected second audio signal. The electronic device 102 may determine a residual echo gain for the selected second audio signal, wherein the noise reduction is based on the residual echo gain value. The electronic device 102 may perform voice activity detection based on minimum statistics (e.g., orthogonal channel noise simulation) with respect to at least one of the selected second audio signal or the first audio signal. The voice activity detection may be used to guide the blind source separation. The electronic device 102 may mitigate echo associated with the third microphone based on determining a noise reference associated with echo cancelled output associated with the third microphone.

The electronic device 102 may perform beamforming based on the first audio signal and a third audio signal corresponding to a fourth microphone of the electronic device 102, and selecting, based on the beamforming, the first audio signal from between the first audio signal and the third audio signal for the blind source separation. Determining whether wind noise is present may be further based on the third audio signal.

The electronic device 102 performs noise suppression with respect to at least one of the first audio signal or the selected second audio signal based on the voice reference value or the noise reference value (610).

As described above, one aspect of the present technology is the gathering and use of data available from specific and legitimate sources for providing user information in association with processing audio signal(s). The present disclosure contemplates that in some instances, this gathered data may include personal information data that uniquely identifies or can be used to identify a specific person. Such personal information data can include demographic data, location-based data, online identifiers, telephone numbers, email addresses, home addresses, data or records relating to a user's health or level of fitness (e.g., vital signs measurements, medication information, exercise information), date of birth, or any other personal information.

The present disclosure recognizes that the use of such personal information data, in the present technology, can be used to the benefit of users. For example, the personal information data can be used for providing information corresponding to a user in association with processing audio signal(s). Accordingly, use of such personal information data may facilitate transactions (e.g., on-line transactions). Further, other uses for personal information data that benefit the user are also contemplated by the present disclosure. For instance, health and fitness data may be used, in accordance with the user's preferences to provide insights into their general wellness, or may be used as positive feedback to individuals using technology to pursue wellness goals.

The present disclosure contemplates that those entities responsible for the collection, analysis, disclosure, transfer, storage, or other use of such personal information data will comply with well-established privacy policies and/or privacy practices. In particular, such entities would be expected to implement and consistently apply privacy practices that are generally recognized as meeting or exceeding industry or governmental requirements for maintaining the privacy of users. Such information regarding the use of personal data should be prominently and easily accessible by users, and should be updated as the collection and/or use of data changes. Personal information from users should be collected for legitimate uses only. Further, such collection/sharing should occur only after receiving the consent of the users or other legitimate basis specified in applicable law. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations which may serve to impose a higher standard. For instance, in the US, collection of or access to certain health data may be governed by federal and/or state laws, such as the Health Insurance Portability and Accountability Act (HIPAA); whereas health data in other countries may be subject to other regulations and policies and should be handled accordingly.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of providing information corresponding to a user in association with processing audio signal(s), the present technology can be configured to allow users to select to "opt in" or "opt out" of participation in the collection of personal information data during registration for services or anytime thereafter. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing identifiers, controlling the amount or specificity of data stored (e.g., collecting location data at city level rather than at an address level), controlling how data is stored (e.g., aggregating data across users), and/or other methods such as differential privacy.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data.

Figure 7:
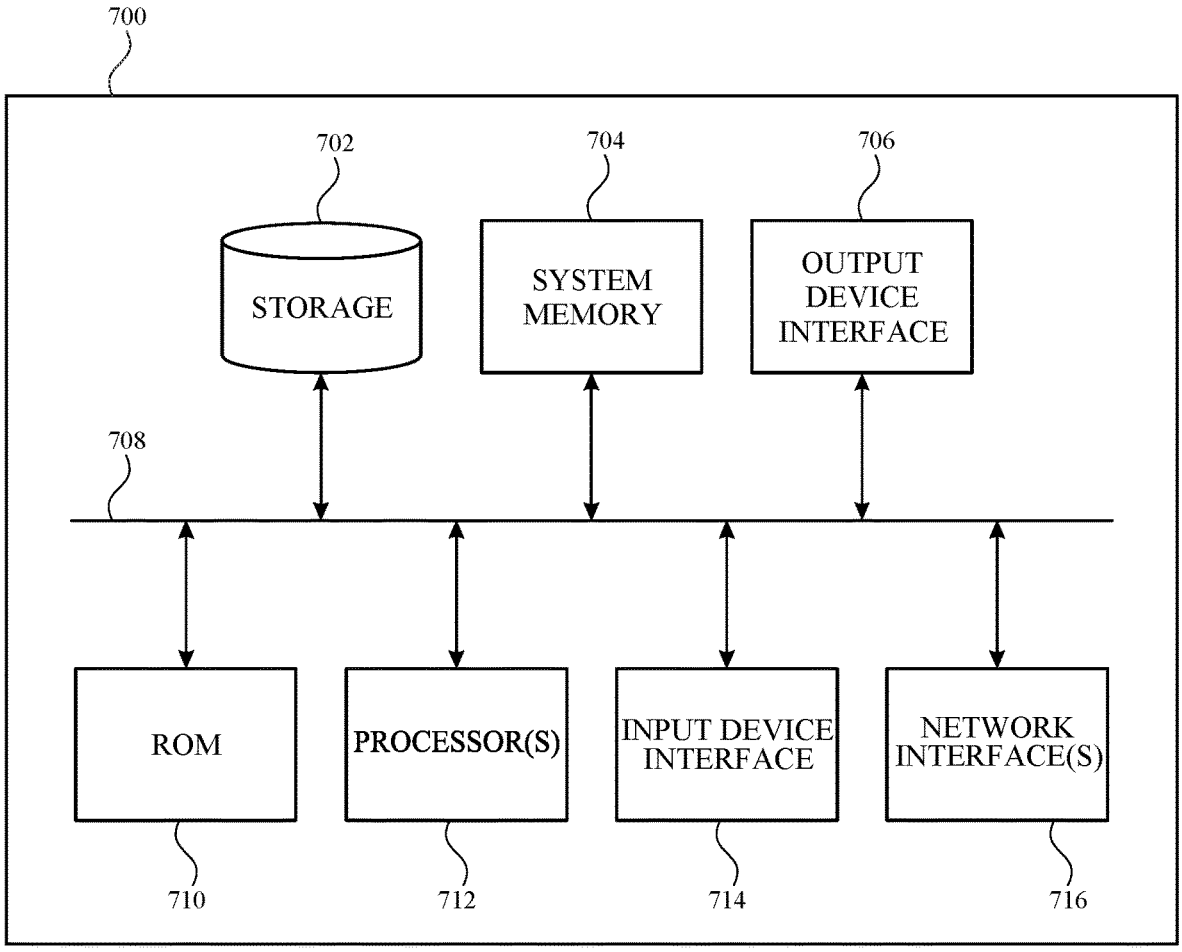
FIG. 7 illustrates an example electronic system with which aspects of the subject technology may be implemented in accordance with one or more implementations.

FIG. 7 illustrates an electronic system 700 with which one or more implementations of the subject technology may be implemented. The electronic system 700 can be, and/or can be a part of, one or more of the electronic devices 102-105, and/or the server 108 shown in FIG. 1. The electronic system 700 may include various types of computer readable media and interfaces for various other types of computer readable media. The electronic system 700 includes a bus 708, one or more processing unit(s) 712, a system memory 704 (and/or buffer), a ROM 710, a permanent storage device 702, an input device interface 714, an output device interface 706, and one or more network interfaces 716, or subsets and variations thereof.

The bus 708 collectively represents all system, peripheral, and chipset buses that communicatively connect the numerous internal devices of the electronic system 700. In one or more implementations, the bus 708 communicatively connects the one or more processing unit(s) 712 with the ROM 710, the system memory 704, and the permanent storage device 702. From these various memory units, the one or more processing unit(s) 712 retrieves instructions to execute and data to process in order to execute the processes of the subject disclosure. The one or more processing unit(s) 712 can be a single processor or a multi-core processor in different implementations.

The ROM 710 stores static data and instructions that are needed by the one or more processing unit(s) 712 and other modules of the electronic system 700. The permanent storage device 702, on the other hand, may be a read-and-write memory device. The permanent storage device 702 may be a non-volatile memory unit that stores instructions and data even when the electronic system 700 is off. In one or more implementations, a mass-storage device (such as a magnetic or optical disk and its corresponding disk drive) may be used as the permanent storage device 702.

In one or more implementations, a removable storage device (such as a floppy disk, flash drive, and its corresponding disk drive) may be used as the permanent storage device 702. Like the permanent storage device 702, the system memory 704 may be a read-and-write memory device. However, unlike the permanent storage device 702, the system memory 704 may be a volatile read-and-write memory, such as random access memory. The system memory 704 may store any of the instructions and data that one or more processing unit(s) 712 may need at runtime. In one or more implementations, the processes of the subject disclosure are stored in the system memory 704, the permanent storage device 702, and/or the ROM 710. From these various memory units, the one or more processing unit(s) 712 retrieves instructions to execute and data to process in order to execute the processes of one or more implementations.

The bus 708 also connects to the input and output device interfaces 714 and 706. The input device interface 714 enables a user to communicate information and select commands to the electronic system 700. Input devices that may be used with the input device interface 714 may include, for example, alphanumeric keyboards and pointing devices (also called "cursor control devices"). The output device interface 706 may enable, for example, the display of images generated by electronic system 700. Output devices that may be used with the output device interface 706 may include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 7, the bus 708 also couples the electronic system 700 to one or more networks and/or to one or more network nodes, such as the server 108 shown in FIG. 1, through the one or more network interface(s) 716. In this manner, the electronic system 700 can be a part of a network of computers (such as a LAN, a wide area network ("WAN"), or an Intranet, or a network of networks, such as the Internet. Any or all components of the electronic system 700 can be used in conjunction with the subject disclosure.

Implementations within the scope of the present disclosure can be partially or entirely realized using a tangible computer-readable storage medium (or multiple tangible computer-readable storage media of one or more types) encoding one or more instructions. The tangible computer-readable storage medium also can be non-transitory in nature.

The computer-readable storage medium can be any storage medium that can be read, written, or otherwise accessed by a general purpose or special purpose computing device, including any processing electronics and/or processing circuitry capable of executing instructions. For example, without limitation, the computer-readable medium can include any volatile semiconductor memory, such as RAM, DRAM, SRAM, T-RAM, Z-RAM, and TTRAM. The computer-readable medium also can include any non-volatile semiconductor memory, such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In one or more implementations, the tangible computer-readable storage medium can be directly coupled to a computing device, while in other implementations, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions also can be realized as or can include data. Computer-executable instructions also can be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessor or multi-core processors that execute software, one or more implementations are performed by one or more integrated circuits, such as ASICs or FPGAs. In one or more implementations, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some implementations, one or more implementations, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other implementations. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for".

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more". Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A method comprising:

receiving a first audio signal corresponding to a first microphone of a device;

determining whether wind noise is present based at least in part on the first audio signal;

selecting, based on determining whether wind noise is present, a second audio signal from between respective audio signals corresponding to a first noise microphone and a second noise microphone of the device, the first noise microphone being disposed on the device at a location that experiences less echo coupling relative to the second noise microphone when the device is in a particular orientation with respect to a user of the device, and the second noise microphone being disposed on the device at another location that experiences less wind noise relative to the first noise microphone when the device is in the particular orientation;

determining a voice reference value and a noise reference value based on the first audio signal and the selected second audio signal; and performing noise suppression with respect to at least one of the first audio signal or the selected second audio signal based on the voice reference value or the noise reference value.

2. The method of claim 1, wherein the first noise microphone is disposed on an outer surface of the device relative to the user when the device is in the particular orientation.

3. The method of claim 1, wherein the second noise microphone is disposed on an inside surface of the device relative to the user when the device is in the particular orientation.

4. The method of claim 1, further comprising:

performing blind source separation using the first audio signal and the selected second audio signal to determine at least one of the voice reference value or the noise reference value.

5. The method of claim 4, wherein the selected second audio signal corresponds to the first noise microphone when the wind noise is not present.

6. The method of claim 5, further comprising:

performing voice activity detection based on a magnitude difference between the selected second audio signal and the first audio signal, wherein the voice activity detection is used to guide the blind source separation.

7. The method of claim 4, wherein the selected second audio signal corresponds to the second noise microphone when the wind noise is present.

8. The method of claim 7, wherein performing the blind source separation is based on a minimal magnitude of the selected second audio signal.

9. The method of claim 7, further comprising:

determining a residual echo gain value for the selected second audio signal, wherein the noise suppression is based on the residual echo gain value.

10. The method of claim 7, further comprising:

performing voice activity detection based on minimum statistics with respect to at least one of the selected second audio signal or the first audio signal, wherein the voice activity detection is used to guide the blind source separation.

11. The method of claim 7, further comprising:

mitigating echo associated with the second noise microphone based on determining a noise reference associated with echo cancelled output associated with the second noise microphone.

12. The method of claim 4, wherein performing the blind source separation comprises separating a voice component and a noise component from the first audio signal and the selected second audio signal, to determine at least one of the voice reference value and the noise reference value.

13. The method of claim 4, further comprising:

performing beamforming based on the first audio signal and a third audio signal corresponding to a fourth microphone of the device;

selecting, based on the beamforming, the first audio signal from between the first audio signal and the third audio signal for the blind source separation.

14. The method of claim 13, wherein determining whether wind noise is present is further based on the third audio signal.

15. A device, comprising:

a voice microphone and first and second noise microphones that are separate from the voice microphone;

at least one processor; and a memory including instructions that, when executed by the at least one processor, cause the at least one processor to:

receive a first audio signal corresponding to the voice microphone of a device;

determine whether wind noise is present based at least in part on the first audio signal;

select, based on determining whether wind noise is present, a second audio signal from between respective audio signals corresponding to the first noise microphone and the second noise microphone of the device, the first noise microphone being disposed on the device at a location that experiences less echo coupling relative to the second noise microphone when the device is in a particular orientation with respect to a user of the device, and the second noise microphone being disposed on the device at another location that experiences less wind noise relative to the first noise microphone when the device is in the particular orientation;

determine a voice reference value and a noise reference value based on the first audio signal and the selected second audio signal; and perform noise suppression with respect to at least one of the first audio signal or the selected second audio signal based on the voice reference value or the noise reference value.

16. The device of claim 15, wherein the first noise microphone is disposed on an outer surface of the device relative to the user when the device is in the particular orientation.

17. The device of claim 15, wherein the second noise microphone is disposed on an inside surface of the device relative to the user when the device is in the particular orientation.

18. A computer program product comprising code, stored in a non-transitory computer-readable storage medium, the code comprising:

code to receive a first sensor signal corresponding to a first sensor of a device;

code to determine whether wind noise is present in the first sensor signal;

code to select, based on determining whether wind noise is present, a second sensor signal from between respective sensor signals corresponding to a second sensor and a third sensor of the device, the second sensor being disposed on the device for reduced echo coupling relative to the third sensor based on an expected orientation of the device, and the third sensor being disposed on the device for reduced wind noise relative to the second sensor based on the expected orientation of the device;

code to perform blind source separation based on the first sensor signal and the selected second sensor signal to determine a voice reference value and a noise reference value; and code to perform noise suppression with respect to the first sensor signal and the selected second sensor signal based on the voice reference value and the noise reference value.

19. The computer program product of claim 18, wherein at least one of the first, second or third sensors corresponds to a microphone, and a respective at least one of the first, second or third sensor signals corresponds to an audio signal.

20. The computer program product of claim 18, wherein at least one of the first, second or third sensors corresponds to an accelerometer, and a respective at least one of the first, second or third sensor signals corresponds to an accelerometer signal.

* * * * *